US009873988B2

(12) United States Patent
Pahl et al.

(10) Patent No.: US 9,873,988 B2
(45) Date of Patent: Jan. 23, 2018

(54) RAIL ARRANGEMENT

(71) Applicant: Daetwyler Sealing Technologies Deutschland GmbH, Walterhausen (DE)

(72) Inventors: Bernd Pahl, Hamburg (DE); Tobias Toczkowski, Rosengarten (DE)

(73) Assignee: Daetwyler Sealing Technologies Deutschland GmbH, Waltershausen (DE)

( * ) Notice: Subject to any disclaimer, the term of this patent is extended or adjusted under 35 U.S.C. 154(b) by 526 days.

(21) Appl. No.: 14/413,462

(22) PCT Filed: Jul. 2, 2013

(86) PCT No.: PCT/DE2013/100239

§ 371 (c)(1),
(2) Date: Jan. 8, 2015

(87) PCT Pub. No.: WO2014/008890

PCT Pub. Date: Jan. 16, 2014

(65) Prior Publication Data

US 2015/0191876 A1 Jul. 9, 2015

(30) Foreign Application Priority Data

Jul. 9, 2012 (DE) ..... 10 2012 106 138

(51) Int. Cl.
*E01B 5/00* (2006.01)
*E01B 5/12* (2006.01)
(Continued)

(52) U.S. Cl.
CPC ..... *E01B 5/12* (2013.01); *E01B 5/10* (2013.01); *E01B 9/02* (2013.01); *E01B 15/00* (2013.01)

(58) Field of Classification Search
CPC ..... E01B 5/10; E01B 5/12; E01B 9/02; E01B 13/00; E01B 15/00; E01B 21/00; E01B 21/02; E01B 21/04
(Continued)

(56) References Cited

U.S. PATENT DOCUMENTS 934,784 A * 9/1909 Alden ..... E01B 5/18 238/17
2,202,336 A * 5/1940 Chmura ..... E01B 13/02 238/379
(Continued)

FOREIGN PATENT DOCUMENTS

DE 457423 A 3/1928
DE 479362 A 6/1929
(Continued)

OTHER PUBLICATIONS

International Preliminary Report on Patentability in International Application No. PCT/DE2013/100239 dated Jan. 13, 2015.

*Primary Examiner* — Jason C Smith
(74) *Attorney, Agent, or Firm* — Patent Central LLC; Stephan A. Pendorf

(57) ABSTRACT

A rail arrangement for rail vehicles furnished with flanged wheels. To reduce the risk of accident existing in connection with grooved rails, particularly for cyclists and pedestrians, a rail arrangement is provided including a. a rail (2) having a rail head (3), a rail web (4) and a rail base (5), the rail head (3) having a drive rail (6), a guide rail (7) and a rail groove (8) lying therebetween; and b. a filler profile (9) arranged in the rail groove (8).

21 Claims, 4 Drawing Sheets

(51) Int. Cl.
*E01B 5/10* (2006.01)
*E01B 15/00* (2006.01)
*E01B 9/02* (2006.01)

(58) Field of Classification Search
USPC ..... 238/121
See application file for complete search history.

(56) References Cited

U.S. PATENT DOCUMENTS 3,311,304 A * 3/1967 Becker ..... E01B 5/18 238/17
3,756,508 A * 9/1973 Bingham ..... E01B 5/02 104/242
3,813,760 A * 6/1974 Arndt ..... B23K 35/3073 219/76.14
5,899,379 A * 5/1999 Bruyn ..... E01B 21/00 238/8
6,213,407 B1 * 4/2001 Ellis ..... E01B 21/00 238/310
6,293,473 B1 * 9/2001 Ortwein ..... E01B 1/002 238/2
D456,744 S * 5/2002 Shavel ..... D12/51
6,401,318 B1 * 6/2002 Bruyn ..... B25B 5/082 238/378
6,701,594 B2 * 3/2004 Bruyn ..... B25B 5/082 238/378
6,726,116 B2 * 4/2004 Hofstetter, Sr. ..... E01C 9/04 238/8
6,764,021 B1 * 7/2004 Birt ..... E01C 9/04 238/2
8,172,158 B1 * 5/2012 Burkhardt ..... E01B 19/003 238/2
8,985,476 B1 * 3/2015 O'Connell ..... E01B 19/00 238/8
9,074,326 B2 * 7/2015 Lowe ..... E01C 9/04
2007/0278322 A1 * 12/2007 Suess ..... E01B 5/04 238/122
2009/0178248 A1 * 7/2009 Buta ..... E01B 19/003 24/568
2009/0206169 A1 * 8/2009 Andre ..... E01B 25/28 238/24
2009/0294546 A1 * 12/2009 Bedford ..... E01B 26/00 238/351
2012/0000988 A1 * 1/2012 Burkhardt ..... E01B 21/00 238/9
2015/0191876 A1 * 7/2015 Pahl ..... E01B 5/10 238/121

FOREIGN PATENT DOCUMENTS

| | | | |
|---|---|---|---|
| DE | 499056 | A | 5/1930 |
| DE | 564508 | A | 11/1932 |
| DE | 591823 | A | 1/1934 |
| DE | 608258 | A | 12/1934 |
| DE | 812674 | B | 7/1951 |
| DE | 2161965 | A1 | 6/1973 |
| DE | 8707445 | U1 | 9/1987 |
| DE | 4030166 | A1 | 3/1992 |
| DE | 4411833 | A1 | 10/1994 |
| DE | 19801583 | A1 | 7/1999 |
| DE | 19859708 | C1 | 5/2000 |
| DE | 10011468 | B4 | 5/2004 |
| DE | 10302521 | A1 | 8/2004 |
| DE | 202005004107 | U1 | 7/2005 |
| DE | 102004018914 | A1 | 10/2005 |
| DE | 102004054794 | B3 | 4/2006 |
| DE | 202004017132 | U1 | 4/2006 |
| EP | 1443148 | A1 | 8/2004 |
| EP | 1462570 | A1 | 9/2004 |
| EP | 2298991 | A1 | 3/2011 |
| GB | 1112870 | A | 5/1968 |
| SU | 1629365 | A1 | 2/1991 |
| WO | 9205313 | A1 | 4/1992 |
| WO | 2008003843 | A2 | 1/2008 |

* cited by examiner

RAIL ARRANGEMENT

BACKGROUND OF THE INVENTION

Field of the Invention

The invention pertains to a rail arrangement for rail vehicles furnished with flanged wheels.

Description of the Related Art

Rail arrangements for rail vehicles furnished with flanged wheels such as, e.g., streetcars are generally known. Corresponding examples are described in DE 100 11 468 B4, DE 103 02 521 A1, DE 44 11 833 A1, DE 198 01 583 A1 and WO 92/05313 A1. Rail arrangements of this type frequently comprise grooved rails, in which a groove that accommodates the wheel flange is formed in the rail head. Grooved rails are also known, for example, from DE 10 2004 018 914 A1, DE 10 2004 054 794 B3, DE 20 2004 017 132 U1, DE 20 2005 004 107 U1, DE 479 362, DE 499 056, DE 608 258, DE 812 674, DE 564 508 and EP 1 462 570 A1.

However, this groove represents a potential safety hazard for outside traffic participants such as, e.g., cyclists, whose tires can get caught in the groove, wherein this regularly leads to sometimes serious accidents. Pedestrians such as, e.g., women wearing shoes with tapered heels or older persons also encounter problems when crossing roads with such rails. In EP 2 298 991 A1, it is therefore proposed to bond a protective insert that preferably consists of plastic, e.g. foamed polyurethane, into the groove. DE 87 07 445 U1 furthermore proposes to fix a filler profile of rubber or rubber-like material in the groove by means of retaining lips and bonding. However, it has become apparent that such solutions are inadequate for largely precluding the risk of accidents for users of two-wheeled vehicles and pedestrians, particularly for reliably and sufficiently closing the groove for the longer term in the unstressed state despite the constantly recurring loads applied by the flanged wheels. Filler profiles of this type particularly are subject to significant wear and/or do not adequately prevent, e.g., bicycle tires from getting caught in the groove.

It is therefore the objective of the present invention to reduce the risk of accidents associated with grooved rails, particularly for users of two-wheeled vehicles and pedestrians, in a more reliable fashion than previous solutions.

BRIEF SUMMARY OF THE INVENTION

This objective is attained with the subject-matter of claim 1. Advantageous embodiments of the invention are disclosed in the dependent claims.

The invention proposes a rail arrangement for rail vehicles furnished with flanged wheels that comprises a. a rail (2) comprising a running rail (6) with a running rail head (16), a guide rail (7) with a guide rail head (17), a rail foot (5), and a rail web (4) connecting the running rail (6) and the guide rail (7) with the rail foot (5), wherein the guide rail (7) is provided on one side of the running rail (6) defining a flange groove (8) between the running rail (6) and the guide rail (7), the flange groove (8) having an upper end with a groove opening (23) and a lower end with a groove bottom (24), and wherein the rail (2) has a rail height $H_S$, the flange groove (8) has a groove depth $T_R$ and the groove depth $T_R$ amounts to at least 35% of the rail height $H_S$, and b. a filler profile (9) arranged in the flange groove (8), wherein the filler profile (9) features an upper part A and a lower part B, and wherein the lower part B can be elastically deformed and the upper part A has a greater hardness and/or rigidity than the lower part B.

The rail arrangement according to the invention solves the above-described problem with a combination of a comparatively deep groove and a filler profile that is arranged in the groove and divided into an elastically deformable lower part B and a comparatively hard or rigid upper part A. When the wheel flange passes over the filler profile, the thusly generated pressure essentially only causes an elastic deformation of the lower part B of the filler profile whereas the rigid/hard upper part A of the filler profile essentially is merely displaced in the vertical direction. After the wheel flange has passed over the filler profile, its upper part A is once again pushed upward by the restoring forces of the elastically deformable lower part B such that the groove is reliably closed. The elastic properties of the elastically deformable lower part B naturally are adapted to the typical pressures or weights exerted by wheel flanges of rail vehicles and, for example, two-wheeled vehicles such that a deformation of the elastically deformable lower part B is in essence only caused by a rail vehicle, but not by a two-wheeled vehicle such as, for example, a bicycle and/or a pedestrian. Accordingly, the hardness/rigidity of the upper part A is also adapted to the occurring alternating pressures or forces.

The flank of the running rail on the groove side and the flank of the guide rail on the groove side may form an angle that slightly opens upward, i.e. toward the groove opening, such as, e.g., an angle of no more than 1-5°, preferably no more than 1-3° or no more than 1-2°. The flanks may also extend essentially parallel to one another. According to the invention, it is particularly preferred that the flank of the running rail on the groove side and the flank of the guide rail on the groove side form an angle $\alpha$ that opens toward the rail foot. In contrast to conventional groove designs, in which the groove flanks extend apart from one another in the direction of the rail head and form a cup-shaped groove with a comparatively wide opening, the inventive design results in a groove that widens toward the rail foot. In this way, the filler profile is reliably held in the groove and does not have to be bonded, for example, to the groove bottom, although this naturally is still possible. A minimal widening toward the rail foot suffices. The angle alpha amounts to at least 0.5°, preferably 1°, particularly 1-5°, especially 1-3°, e.g. 1°, 1.5°, 2°, 2.5° or 3°.

In order to additionally anchor the filler profile in the groove, the groove side of the running rail and/or the guide rail may be provided with one or more undercuts, recesses, projections or the like, into which the filler profile can engage with corresponding complementary projecting retaining lips or recesses.

In a preferred embodiment of the rail arrangement of the invention, the groove depth $T_R$ amounts to at least 40%, preferably at least 45%, particularly at least 50%, of the rail height $H_S$. The rail height $H_S$ is the dimension between the bottom of the rail foot and the surface of the running rail or the horizontal tangent on the running rail surface and the groove depth $T_R$ is the dimension between the surface of the running rail or the horizontal tangent on the running rail surface and the groove bottom at the height midway between the flanks of the running rail and the guide rail on the groove side.

The upper part A of the filler profile pointing toward the rail head may consist of the same material as the lower part B pointing toward the rail foot or of a different material. For example, both upper and lower parts A and B may consist of elastomeric material. Suitable elastomeric materials are, for example, materials on the basis of styrene-butadiene rubber (SBR), natural rubber (NR), a natural rubber/butyl rubber mixture (NR/BR) or ethylene-propylene-diene rubber (EPDM).

For example, one suitable material for the filler profile is SBR with the properties specified below in Table 1.

TABLE 1

Material properties of a suitable filler profile material (SBR-polymer, measured on plates, d = days, RT = room temperature):

| Property | Measuring method | Value | Unit |
|---|---|---|---|
| Shore hardness A | DIN 53505<br>ISO 7619 | 62 ± 5 | SHE |
| Tearing resistance | DIN 53504<br>ISO 37 | >10.0 | $N/mm^2$ |
| Elongation at tear | DIN 53504<br>ISO 37 | >380 | % |
| Ageing 7 d/70° C.<br>(relative change) | ISO 53508<br>ISO 88 | | |
| Shore hardness A | DIN 53505<br>ISO 7619 | 8 | SHE |
| Tearing resistance | DIN 53504<br>ISO 37 | ±15 | % |
| Elongation at tear | DIN 53504<br>ISO 37 | ±25 | % |
| Tear propagation resistance<br>(method A) | DIN 53507<br>ISO 34 | ≥8 | N/mm |
| Rebound resilience<br>(at RT) | DIN 53512<br>ISO 815 | ≥25 | % |
| Compression set | DIN 53517<br>ISO 815 | | |
| 72 h/RT | | ≤30 | % |
| 24 h/70° C. | | ≤35 | % |
| Ozone 0.5 ppm/48 h/RT | DIN 53509<br>ISO 1431 A | 0 | stage |
| Abrasion | DIN 53516<br>ISO 4649 A | ≤200 | $mm^2$ |
| Volume resistivity | DIN IEC 93 | $>1 * 10^9$ | Ohm * cm |
| Temperature range | | −30 to 80 | ° C. |

The upper part A of the filler profile pointing toward the rail head may consist of a harder elastomer than the lower part B pointing toward the rail foot, for example have a greater Shore hardness A. Alternatively or additionally, both parts A and B may consist of an elastomer with the same degree of hardness, but the upper part A is realized solid whereas the lower part B is realized with gas-filled, e.g. air-filled, cavities or in a foamlike fashion. Gas-filled microspheres may also be incorporated into the lower part B. The upper part A of the filler profile also may at least partially consist of a thermoplastic elastomer, a thermosetting polymer, metal or the like whereas the lower part B of the filler profile consists of an elastomer. For example, the upper part A may also feature an additional coating of a thermoplastic elastomer such as, e.g., a polyethylene layer, namely even if it consists of an elastomer. Although it is preferred that the lower part B consists of an elastomer, it would also be possible, in principle, to realize the lower part B in the form of a metal spring.

The upper part A of the filler profile is preferably realized as wear-resistant as possible such that it can withstand the loads applied by the wheel flanges as long as possible without having to be replaced or without being subjected to excessive abrasion that would cause the surface of the filler profile to be recessed deeper within the groove and therefore expose the groove. For this purpose, it would also be possible to incorporate hard particles such as, for example, metal or plastic particles into the upper part A.

The upper and lower parts A and B preferably are rigidly connected to one another or realized in one piece. If different elastomeric materials are used, the upper and lower parts A and B may be integrally connected to one another, for example, by means of coextrusion. It would naturally also be possible to produce the connection by means of bonding, threaded joints, vulcanizing, etc.

The elastically deformable lower part B of the filler profile pointing toward the rail foot preferably constitutes the majority of the filler profile. For example, the height $H_{FB}$ of the lower part B of the filler profile amounts to at least 60%, preferably at least 65%, for example 70%, 75%, 80% or 85%, of the overall height $H_F$ of the filler profile. The upper part A preferably has a minimum height, i.e. a minimum layer thickness. It is preferred that the height $H_{FA}$ of the upper part A of the filler profile pointing toward the rail head amounts to at least 15%, particularly at least 20%, especially 25%, 30% or 45%, of the overall height $H_F$ of the filler profile. Examples for suitable percental ratios between the heights of the parts A and B are 60/40, 65/35, 70/30, 75/25, 80/20 and 85/15. For example, the overall height $H_F$ of the filler profile, as well as the height ratios between the parts A and B, can be determined based on the height of the wheel flange.

The upper surface, i.e. the surface of the filler profile, over which the wheel flange passes, is preferably realized in a non-skid fashion, for example profiled or roughened. For this purpose, it would also be possible to incorporate hard particles into the surface of the filler profile.

The guide rail may be realized in one piece with the running rail or preferably in the form of a separate component. In the latter instance, the guide rail preferably is suitably connected to the running rail, for example bolted or welded to the rail web. For example, the running rail may consist of a conventional Vignol rail or crane rail, on the rail web of which a guide rail is mounted. The running rail and the guide rail preferably consist of conventional rail materials, typically of metal.

In a particularly preferred embodiment of the rail arrangement of the invention, the sides of the filler profile, i.e. the surfaces that face the flanks of the miming rail and the guide rail, particularly those of the upper part A, are coated with an easily sliding material such as, for example, a smooth plastic material. The sides are preferably coated with polytetrafluoroethylene (PTFE). In this way, the filler profile can slide along the flanks of the running rail and the guide rail more easily when it is pushed down by the wheel flange, as well as during the restoration of the filler profile, such that the filler profile quickly reassumes its original position after the wheel flange has passed over it and the wear due to abrasion is minimized.

The filler profile preferably has a cross section that widens toward the rail foot, i.e. the filler profile widens toward the groove bottom. This makes it possible to achieve an improved seat of the filler profile, particularly in an embodiment, in which the flanks of the mining rail and the guide rail on the groove side also extend apart from one another toward the rail foot such that the groove cross section widens toward the rail foot.

The filler profile may be realized in the form of a one-piece, two-piece or multipiece filler profile. In an embodiment, in which a combination of a Vignol rail and a guide rail bolted or welded to the rail web thereof is provided, for example, it may be advantageous to arrange a separate profiled part such as, e.g., a profiled part with a circular cross section in the hollow space formed on the groove side between the rail web, the guide rail and the underside of the running rail head. In this way, the installation of the filler profile is also simplified, for example, if the guide rail is welded to the miming rail. In this case, a restiform profiled part can initially be placed into the aforementioned hollow space and the remainder of the filler profile can subsequently be installed. The separate profiled part may consist of the same material as the upper part A and/or the lower part B of the filler profile or of a different material or a different material combination.

In the unstressed state, the upper surface of the filler profile preferably lies essentially at the level of the guide rail head. In this way, an essentially plane surface is formed in the groove region such that cyclists and pedestrians can respectively ride or walk across the rails without increased risk of falling.

BRIEF DESCRIPTION OF THE SEVERAL VIEWS OF THE DRAWINGS

The invention is described in greater detail below with reference to the attached figures that show preferred embodiments of the invention purely for elucidative purposes. In these figures.

DETAILED DESCRIPTION OF THE INVENTION

Figure 1:
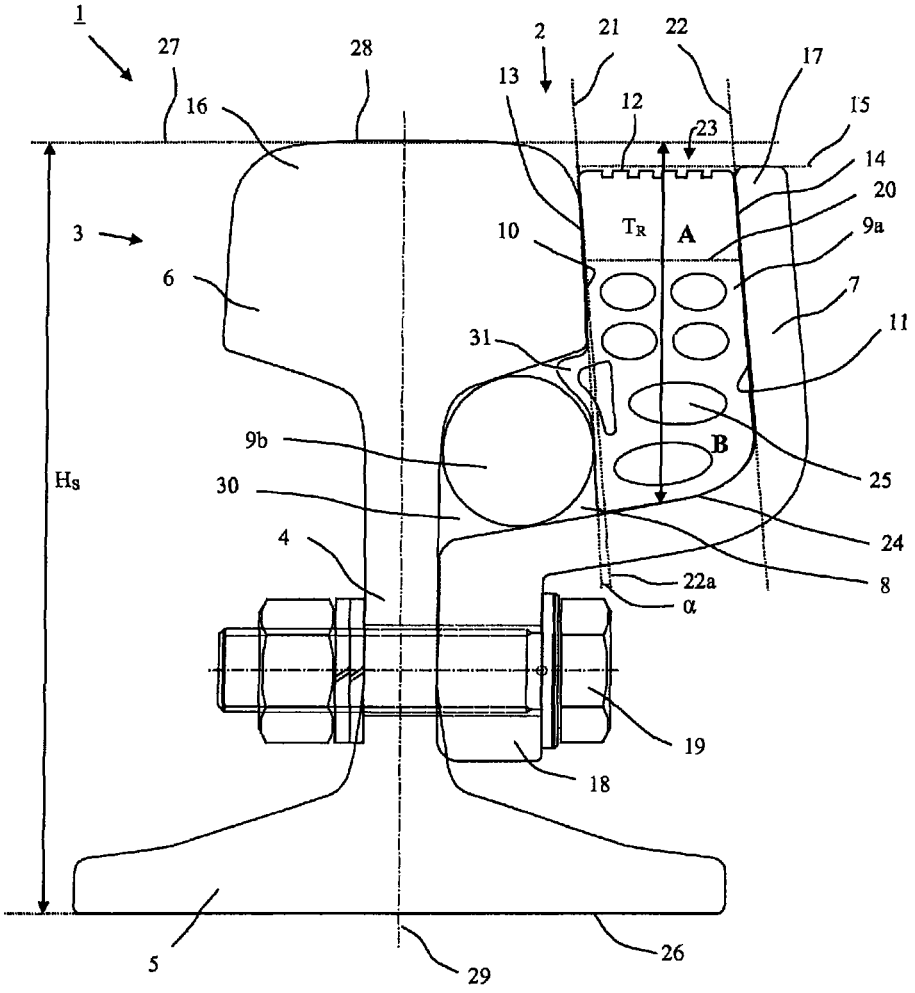
FIG. 1 shows a preferred embodiment of the rail arrangement according to the invention in the form of a cross section.

FIG. 1 schematically shows a cross section through a rail arrangement 1 according to the invention. The rail arrangement 1 comprises a rail 2 with a rail head 3, a rail web 4 and a rail foot 5. The running rail 6 has a running rail head 16 and a guide rail 7 has a guide rail head 17. In this case, the rail 2 consists of a Vignol rail that is essentially realized symmetrical referred to its central longitudinal axis 29, wherein the rail web 4 of said rail is connected to a guide rail 7 by means of a flange 18 and a bolt connection 19. In FIG. 1, broken lines 21, 22 are drawn along the flank 10 of the running rail 6 or the running rail head 16 on the groove side and the flank 11 of the guide rail 7 on the groove side. The broken line 22*a* extending parallel to the line 22 was drawn as an aid for elucidating the angle α foil red between the flanks 10, 11 on the groove side. The flanks 10, 11 extend apart from one another toward the rail foot 5 such that an angle α is formed between the flanks 10, 11. The cross section of the flange groove 8 therefore widens from its opening 23 toward its bottom 24. In this case, the groove depth $T_R$, i.e. the dimension between the horizontal tangent 27 on the surface 28 of the running rail head 16 and the groove bottom 24 at the height midway between the two flanks 10, 11, amounts to approximately 40% of the rail height $H_S$, i.e. the dimension between the horizontal tangent 27 on the surface 28 of the running rail head 16 and the base 26, i.e. the underside, of the rail foot 5.

A groove 8 is formed between the running rail 6 and the guide rail 7 and a filler profile 9 consisting of two components 9*a*, 9*b* is inserted into said groove. The filler profile 9 consists of an upper upper part A that points toward the rail head 3 or the groove opening 23 and a lower lower part B that points toward the rail foot 5 or the groove bottom 24. In this figure, the boundary between the upper part A and the lower part B is merely indicated in the form of the broken line 20 for illustrative purposes because both parts are integrally connected to one another. The upper part A of the filler profile 9*a* consisting of elastomeric material is realized solid in this case whereas the lower part B of the filler profile 9*a* consisting of elastomeric material respectively features gas-filled or air-filled channels 25. The surface 12 of the upper part A is profiled. The surface 12 of the upper part A essentially lies at the level 15 of the guide rail head 17. The filler profile 9 engages behind the running rail head 16 with a retaining lip 31.

Figure 2:
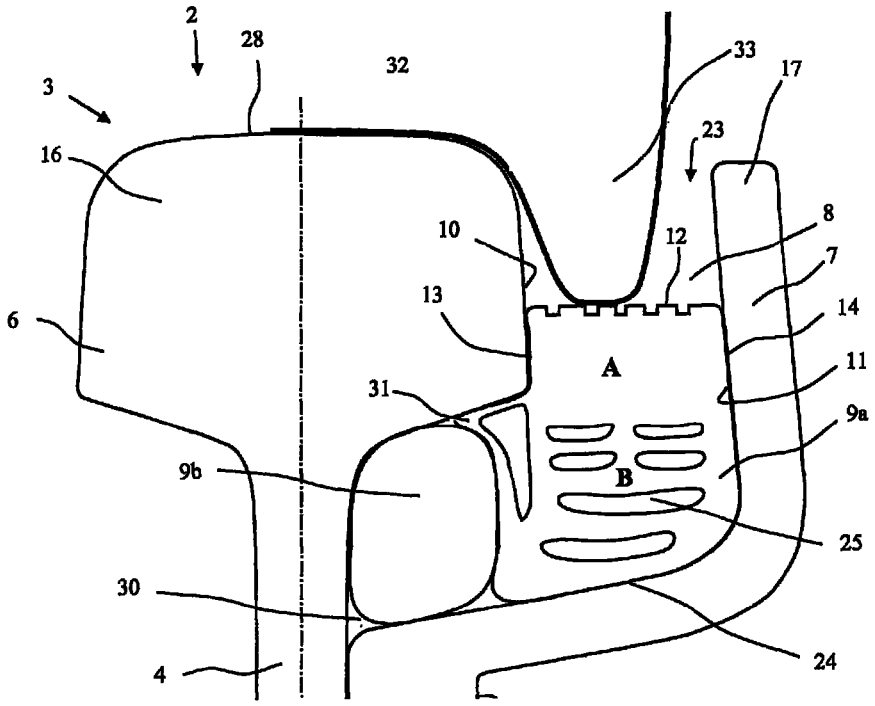
FIG. 2 shows a detail of the rail arrangement according to FIG. 1 under a load.

FIG. 2 schematically shows the rail arrangement 1 of the invention according to FIG. 1 under a load. A merely indicated flanged wheel 32 rolling along the running rail head 16 presses the filler profile 9*a* into the groove with its wheel flange 33. The upper part A of the filler profile 9*a* slides in the direction of the groove bottom 24 along the flanks 10, 11 of the running rail 6 and the guide rail 7 with its PTFE-coated sides 13, 14. The upper part A essentially maintains its shape whereas the lower part B is elastically deformed. The air-filled channels 25 are compressed during this elastic deformation. The restiform filler profile component 9*b* arranged in the hollow space 30 underneath the underside of the running rail head 16 on the groove side is also deformed in this case such that it essentially fills out the hollow space 30. However, it may also be realized such that it essentially maintains its shape. As soon as the flanged wheel 32 with its wheel flange 33 has rolled over the filler profile 9 such that it is no longer subjected to a load, the filler profile 9 reassumes its original shape. The upper part A essentially slides in the direction of the flange groove opening 23 due to the restoring forces of the lower part B and in this way closes the flange groove 8. The filler profile 9 is held in the flange groove without requiring bonding or the like. In this case, a reliable retention is ensured due to the cross-sectional widening of the filler profile 9 and the flange groove 8 toward the groove bottom 23, as well as the retaining lip 31.

Figure 3:
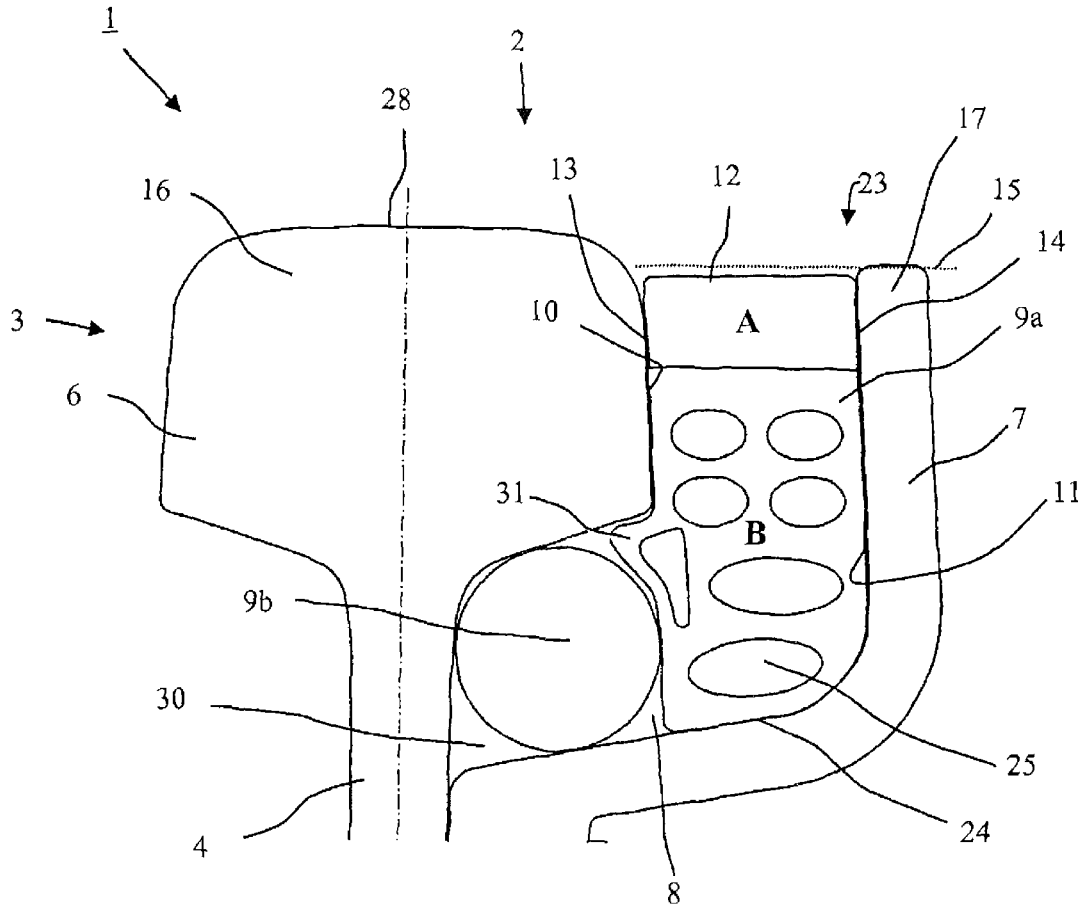
FIG. 3 shows another embodiment of the rail arrangement according to the invention in the form of a cross section.

FIG. 3 shows a detail of another embodiment of the inventive rail arrangement 1. The rail arrangement 1 can merely be distinguished from the rail arrangement illustrated in FIG. 1 or 2 in that the upper part A of the filler profile 9 consists of metal. The upper part A is rigidly connected to the elastically deformable lower part B of the filler profile 9 by means of bonding. A coating such as, e.g., a PTFE-coating may also be provided on the sides of the filler profile 9 in this case, particularly in the region of the upper part A. In other respects, the rail arrangement 1 according to FIG. 3 corresponds to the rail arrangement illustrated in FIGS. 1 and 2 such that we refer to the preceding description thereof.

Figure 4:
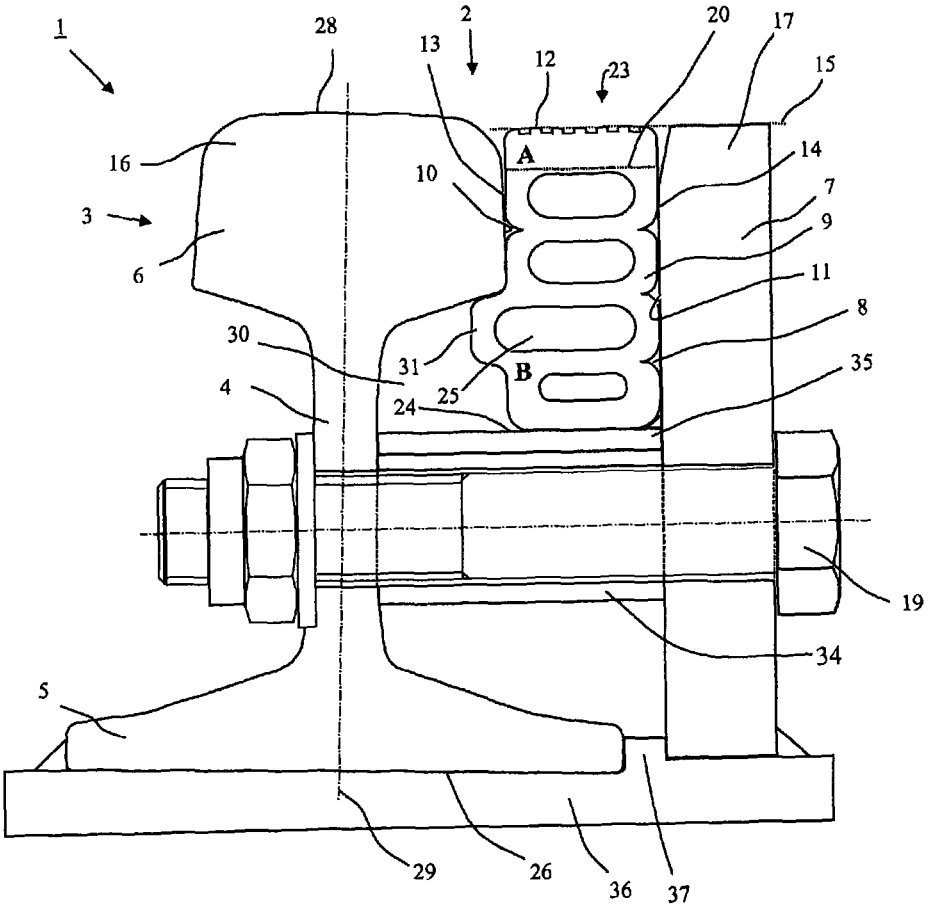
FIG. 4 shows another embodiment of the rail arrangement according to the invention in the form of a cross section.

FIG. 4 shows a cross section through another embodiment of an rail arrangement 1 according to the invention, wherein characteristics corresponding to the embodiment illustrated in FIG. 1 are identified by the same reference symbols. In this embodiment, the running rail 6 and the separate guide rail 7 are arranged on a common base 36 that consists of a suitable metal in this case, but may also be made of plastic or an elastomer. The facing sides of the running rail 6 and the guide rail 7 respectively abut on a projection 37 formed by the base 36 whereas their outer sides are welded to the base 36 and thusly fixed in position. The running rail 6 and the guide rail 7 are connected to one another by means of a bolt connection 19 in this case, wherein a metallic sleeve 34 acts as a spacer. The groove bottom 24 is formed by a supporting plate 35 arranged on the sleeve 34 in this case, wherein said supporting plate extends between the running rail 6 and the guide rail 7 parallel to the rail 2 and is bonded to the underside of the filler profile 9 arranged on the supporting plate 35. In this embodiment, the longitudinal axis 29 of the running rail 6 is slightly inclined, e.g. 1:40, relative to the horizontal line in the direction of the flange groove 8 or the running rail 7, respectively. The flanks 10, 11 of the running rail 6 and the guide rail 7 on the groove side extend nearly parallel in this case and form a slight opening toward the groove opening 23. However, an angle that opens toward the rail foot 5 may also be realized, if applicable, with a corresponding design of the guide rail 7. The filler profile 9 features a retaining lip 31, by means of which the filler profile 9 engages behind the running rail head 16. The retaining lip 31 ensures that the filler profile 9 is additionally fixed in the flange groove 8. It is neither absolutely imperative to provide the retaining lip 31 nor to bond the filler profile 9 to the supporting plate 35 in order to hold the filler profile 9 in the intended position, but both are suitable for complicating an unforeseen or willful removal of the filler profile 9. The upper and lower parts A and B of the filler profile 9 are realized in one piece by means of coextrusion. The groove depth $T_R$ amounts to approximately 48% of the rail height $H_S$ in this case. When a rail vehicle such as, e.g., a streetcar passes over the upper part A of the filler profile 9 consisting of wear-resistant material, the filler profile 9 is elastically deformed, namely compressed in the vertical direction, and yields into the hollow space 30. Correspondingly designed restoring forces subsequently ensure that the filler profile 9 returns into its initial position. The elastic properties of the filler profile 9 are realized in such a way that the weight of a rail vehicle passing over the filler profile 9 leads to a compression thereof whereas the weight of a bicycle or a pedestrian causes no compression or only an insignificant compression of the filler profile 9.

The invention claimed is:

1. A rail arrangement (1) for rail vehicles furnished with flanged wheels, comprising a. a rail (2) comprising a running rail (6) with a running rail head (16), a guide rail (7) with a guide rail head (17), a rail foot (5), and a rail web (4) connecting the running rail (6) and the guide rail (7) with the rail foot (5), wherein the guide rail (7) is provided on one side of the running rail (6) defining a flange groove (8) between the running rail (6) and the guide rail (7), the flange groove (8) having an upper end with a groove opening (23) and a lower end with a groove bottom (24), and wherein the rail (2) has a rail height $H_S$, the flange groove (8) has a groove depth $T_R$ and the groove depth $T_R$ amounts to at least 35% of the rail height $H_S$, and b. a filler profile (9) arranged in the flange groove (8), wherein the filler profile (9) features an upper part A and a lower part B, and wherein the lower part B can be elastically deformed and the upper part A has a greater hardness and/or rigidity than the lower part B.

2. The rail arrangement according to claim 1, wherein the running rail (6) has a flank (10) facing the groove and the guide rail (7) has a flank (11) facing the groove and wherein said flank (10) of the running rail (6) and said flank (11) of the guide rail (7) form an angle α that opens toward the rail foot (5).

3. The rail arrangement according to claim 2, wherein the angle α amounts to at least 1°.

4. The rail arrangement according to claim 2, wherein the angle α amounts 1-5°.

5. The rail arrangement according to claim 2, wherein the angle α amounts to 1-3°.

6. The rail arrangement according to claim 2, wherein the angle α amounts to at least 0.5°.

7. The rail arrangement according to claim 1, wherein the groove depth $T_R$ amounts to at least 40% of the rail height $H_S$.

8. The rail arrangement according to claim 1, wherein the upper part A of the filler profile (9) consists at least partially of metal and the lower part B of the filler profile (9) is comprised of an elastomer.

9. The rail arrangement according to claim 1, wherein the upper part A and lower part B of the filler profile (9) both are comprised of elastomeric material, wherein the upper part A of the filler profile (9) consists of a harder elastomer than the lower part B of the filler profile (9).

10. The rail arrangement according to claim 1, wherein the filler profile (9) has a height HP, the upper part A of the filler profile (9) has a height $H_{FA}$, and wherein the height $H_{FA}$ of the upper part A of the filler profile (9) amounts to at least 15% of the overall height $H_F$ of the filler profile (9).

11. The rail arrangement according to claim 1, wherein the filler profile has an upper surface (12), and wherein said upper surface (12) of the filler profile is profiled.

12. The rail arrangement according to claim 1, wherein the rail (2) is realized in one piece or the guide rail (7) is a separate component and is bolted or welded to the rail web (4).

13. The rail arrangement according to claim 1, wherein the filler profile (9) has a side (13) facing the running rail (6) and a side (14) facing the guide rail (7) and wherein said sides (13, 14) of the filler profile (9) are coated with an easily sliding material.

14. The rail arrangement according to claim 13, wherein said easily slidable material is polytetrafluoroethylene (PTFE).

15. The rail arrangement according to claim 1, wherein the filler profile (9) has a cross section that widens toward the rail foot (5).

16. The rail arrangement according to claim 1, wherein the filler profile (9) is a one-piece, two-piece or multipiece filler profile.

17. The rail arrangement according to claim 1, wherein the filler profile has an upper surface (12), and wherein said upper surface (12) of the filler profile (9) essentially lies at the level (15) of the guide rail head (17).

18. The rail arrangement according to claim 1, wherein the rail (2) has a rail height $H_S$ and wherein the groove depth $T_R$ amounts to at least 45% of the rail height $H_S$.

19. The rail arrangement according to claim 18, wherein the groove depth $T_R$ amounts to at least 50%, of the rail height $H_S$.

20. The rail arrangement according to claim 1, wherein the filler profile (9) has a height $H_F$, the upper part A of the filler profile (9) has a height $H_{FA}$, and wherein the height $H_{FA}$ of the upper part A of the filler profile (9) amounts to at least 30% of the overall height $H_F$ of the filler profile (9).

21. The rail arrangement according to claim 1, wherein the filler profile (9) has a height $H_F$, the upper part A of the filler profile (9) has a height $H_{FA}$, and wherein the height $H_{FA}$ of the upper part A of the filler profile (9) amounts to at least 45% of the overall height $H_F$ of the filler profile (9).

* * * * *